United States Patent [19]

Hooper

[11] 4,429,403

[45] Jan. 31, 1984

[54] HEATING ELEMENT INSULATING AND SUPPORT SYSTEM

[75] Inventor: John H. Hooper, Oakville, Canada

[73] Assignee: Vac-Aero International Inc., Ontario, Canada

[21] Appl. No.: 422,029

[22] Filed: Sep. 23, 1982

[30] Foreign Application Priority Data

Sep. 30, 1981 [CA] Canada ..... 387011

[51] Int. Cl.[3] ..... F27D 11/02; H05B 3/02

[52] U.S. Cl. ..... 373/128; 373/111

[58] Field of Search ..... 373/111, 112, 114, 117, 373/119, 128, 130, 132, 134, 137

[56] References Cited

U.S. PATENT DOCUMENTS

| | | | |
|---|---|---|---|
| 2,532,562 | 12/1950 | Long . | |
| 2,551,039 | 5/1951 | Nelson . | |
| 3,045,097 | 7/1962 | Zellers . | |
| 3,737,553 | 6/1973 | Kreider et al. . | |
| 3,812,276 | 5/1974 | Cyrway, Jr. et al. . | |
| 4,056,678 | 11/1977 | Beall et al. | 373/130 |
| 4,195,820 | 4/1980 | Berg | 373/136 |
| 4,259,538 | 3/1981 | Jones . | |
| 4,321,415 | 3/1982 | Christian et al. | 373/128 |

FOREIGN PATENT DOCUMENTS

| | | |
|---|---|---|
| 229839 | 3/1923 | Canada . |
| 267091 | 12/1926 | Canada . |
| 288941 | 4/1929 | Canada . |
| 293447 | 10/1929 | Canada . |
| 387582 | 3/1940 | Canada . |
| 408747 | 11/1941 | Canada . |
| 569818 | 2/1959 | Canada . |
| 580648 | 8/1959 | Canada . |
| 826235 | 10/1969 | Canada . |

*Primary Examiner*—Roy N. Envall

*Attorney, Agent, or Firm*—David A. Burge

[57] ABSTRACT

An arrangement for mounting and insulating strip sheet heating elements in the heated interior of vaccum furnaces comprises a plurality of rods secured at one end to a support liner and supporting at their other ends a heating element assembly which includes a heating element, insulators, retaining or locating pins and a reinforcing member for the heating element. The arrangement may also include means for transferring quenching gases to the interior working space of vacuum furnaces, consisting of an integral manifold or plenum support ring assembly and a plurality of locked in tubes which route the gases directly into the working section of the furnace.

8 Claims, 9 Drawing Figures

HEATING ELEMENT INSULATING AND SUPPORT SYSTEM

BACKGROUND OF THE INVENTION

This invention relates to vacuum furnaces and in particular to resistant heating elements and support means for vacuum furnaces.

Numerous types of heating elements for vacuum furnaces are known. Conventional arrangements for supporting heating elements in vacuum furnaces may be found in U.S. Pat. No. 3,737,553 Kreider et al, June 5, 1973, 3,812,276 Cyrway Jr. et al, May 21, 1974 and 4,259,538 Jones, Mar. 31, 1981. The use of supporting plates, clips etc. to support and increase the cross section of heating elements is a design approach which has been used for some time in both regular furnace and vacuum furnace construction. However, conventional designs including those in the above mentioned patents have not fully overcome inherent weaknesses of wide band, thin sheet metal heating elements. Inherent problems with such sheeting elements is the lack of strength of the element at its point of support on a support pin or rod. This is due in part to the decrease in the heating element cross section in the area of the aperture or hole which locates the heating element on the supporting pin or rod.

SUMMARY OF THE INVENTION

The present invention provides an improved arrangement for mounting and insulating strip sheet heating elements in the heated interior or hot zone of vacuum or atmosphere furnaces. In common with conventional practice, resistant heating elements in a furnace of the present invention are only located on the inside periphery of a main shield package but, depending on the temperature uniformity required and the size of the furnace, additional heating elements may also be positioned across inside surfaces of the front and rear shield packages. The heating element consists of strips of pure molybdenum sheet or other suitable materials such as tungsten, columbium, tantalum or nickel chromium, nickel chromium iron or other suitable alloy sheets. When located on a main shield package, the resistant heating elements are formed into a circular configuration and attached to suitable power terminals or buss bars depending on the design of the electric circuitry.

An improved supporting arrangement comprises a plurality of rods which are each secured at one end to a support liner and supporting at their other ends a heating element assembly which includes the resistant element itself, insulators, retaining or locating pins and a reinforcing member to strengthen the heating element.

According to one broad aspect, the invention relates to an improved support means for a resistance heating element of a vacuum furnace, the support means comprising a support liner, a heating element support assembly and a rod member interconnecting the support liner and the element support assembly. The element support assembly is mounted on the inner end of the rod and includes a pair of insulators concentrically located on the rod and defining between them an insulated groove which freely supports the heating element therein. Means locate and retain the element support assembly on the inner end of the rod and a retaining rod interconnects adjacent rod members and spaces the support liner from the element support assembly. Means are secured to the support liner and releasably engage the inner end of the rod members and means are located in the groove of the insulators and secured to the resistant heating elements to strengthen the element at the support assembly location.

In a preferred arrangement, the pair of insulators include first and second ceramic members which, when mounted together, define the insulated groove between them, one of the ceramic bodies being a sleeve mounted over a boss portion of the other ceramic member, in telescopic relationship.

The means to strengthen the resistant heating element at the support point or assembly location consists of a channel shaped member of the same material as the resistant heating element and having a flat rectangular web portion secured to the element with stiffening ribs along parallel side edges thereof.

The invention further relates to gas support means in vacuum furnaces. Conventional designs have nozzle tubes which fit over spigots on a support liner. The tubes direct gas from these spigots past the heat reflecting shields and heating elements to the interior of the furnace. The tubes are held in place by one time use spring clips when catch on the exterior of the support liner through the spigot holes and are bent over the exhaust end of the nozzle tube. Problems with the design include: tube distortion at high temperatures caused by tension from the spring clip bearing down on the thin tube walls resulting in lower nozzle exit area, hence reduced gas flow; possible failure of spring clips resulting in loss of nozzle support; and difficulty in re-installing the clip spring when replacing damaged or warped tubes.

BRIEF DESCRIPTION OF THE DRAWINGS.

The invention is illustrated by way of example in the accompanying drawings in which:

Referring to FIG. 1, a fragmentary end view in cross section of a vacuum furnace 10 shows the resistance heating element 12 connected to suitable power terminal 14 and being supported at spaced intervals on its periphery by support means of the present invention indicated generally at 16. As shown on FIG. 1, the heating elements 12 are located on the inside periphery of a main shield package consisting of either heat insulation or heat reflecting shields 18. Conventionally, the furnace 10 includes hearth pins 20 and rails 22 for supporting suitable load in the furnace indicated by phantom line 24.

Turning now to FIGS. 2 through 5, the improved support means 16 includes a support liner 26, a heating element support assembly and a rod member 30 which interconnects the support liner 26 and the element support assembly 28. Assembly 28 is mounted on the inner end of the rod 30 and the assembly includes a pair of ceramic insulators 34, 36 which are concentrically located on the rod 30 and defining between them an insulated groove 38 which freely supports the resistant heating element 12 therein. The first ceramic member 34 has a peripheral flange 40 thereon and a concentric protruding boss 42 which supports the suitably apertured heating element 12. The second ceramic member 36 is in the form of a washer having a diameter approximately that or greater than the flange 40 which, together with that flange defines the groove 38.

Figure 1:
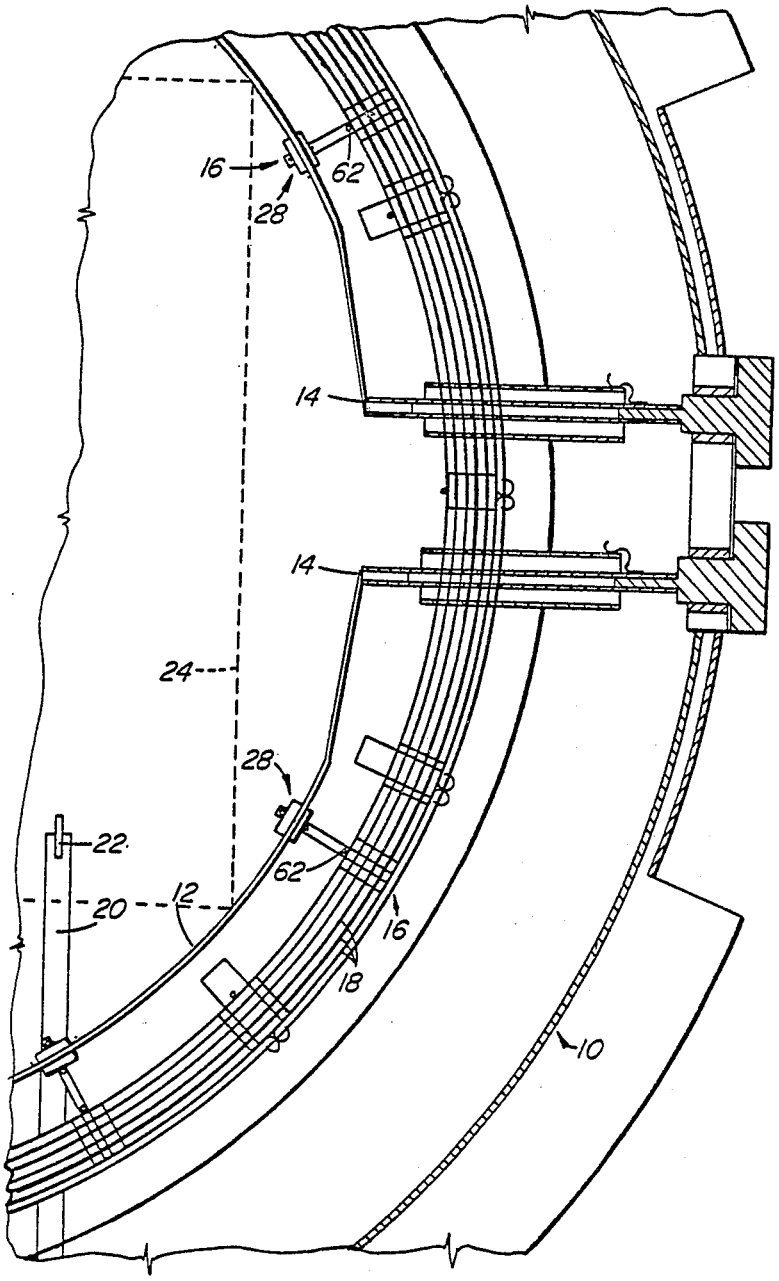
FIG. 1 is a fragmentary schematic view of a portion of a vacuum furnace illustrating the location of the present invention.

Means for locating and retaining the assembly 28 on the inner end of the rod consists of retainer clips 44, 46, sandwiched between locking pins 48 and 50 which are positioned in drilled passageways in the inner end of the rod.

Means for strengthening the resistant heating element 12 at the point of support consists of a channel shaped member 52 formed from the same material as the resistance heating element 12 and consisting of a flat rectangular web 54 which may be spot welded, riveted, bolted or otherwise secured to the heating element 12 and which is also provided with stiffening ribs or flanges 56 along a pair of its parallel side edges.

The means for securing the support liner 26 to the rod 30 consists of a captive nut 58 welded in place on the liner 56 and threaded to receive the threaded end of the rod 30. The captive nut locations coincide with suitable apertures 60 through the heat shield package 18 and the rod 30 is screwed into the nut 58 and is prevented from turning and coming loose by a common retaining rod 62 which is inserted through suitable apertures drilled in the rods 30 and rod 62 extends between a plurality of the rods 30 and they also retain the inner face heat shield 18 in position.

Figure 2:
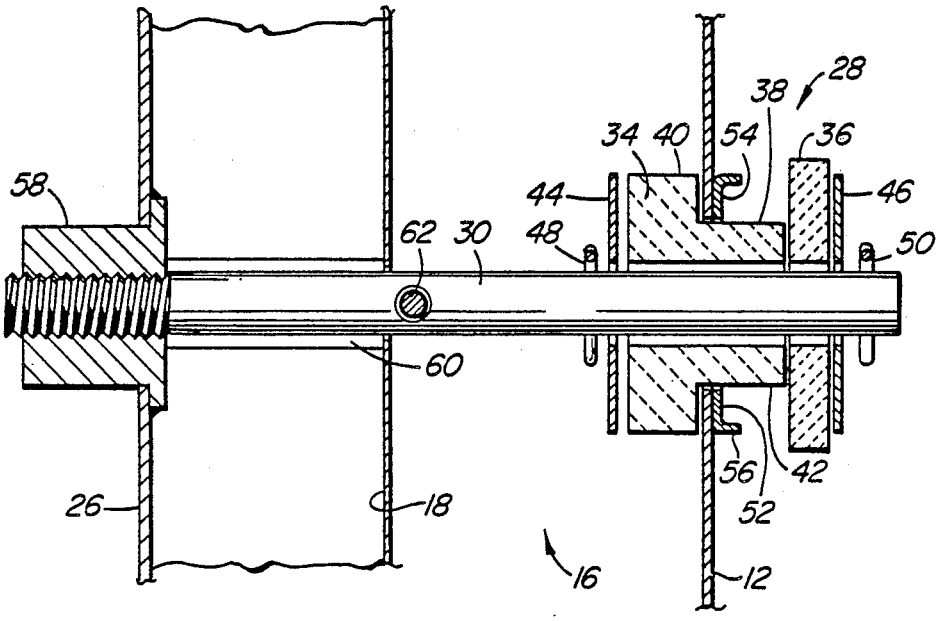
FIG. 2 is a cross section view of one arrangement of the support means.
Figure 3:
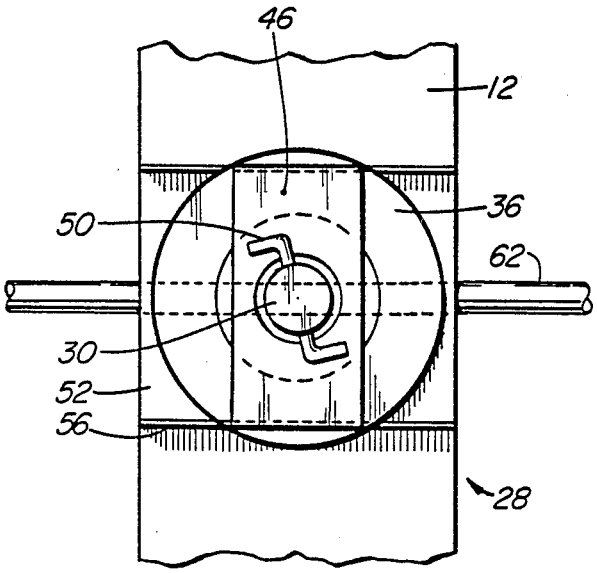
FIG. 3 is an end view of the arrangement in FIG. 2.
Figure 4:
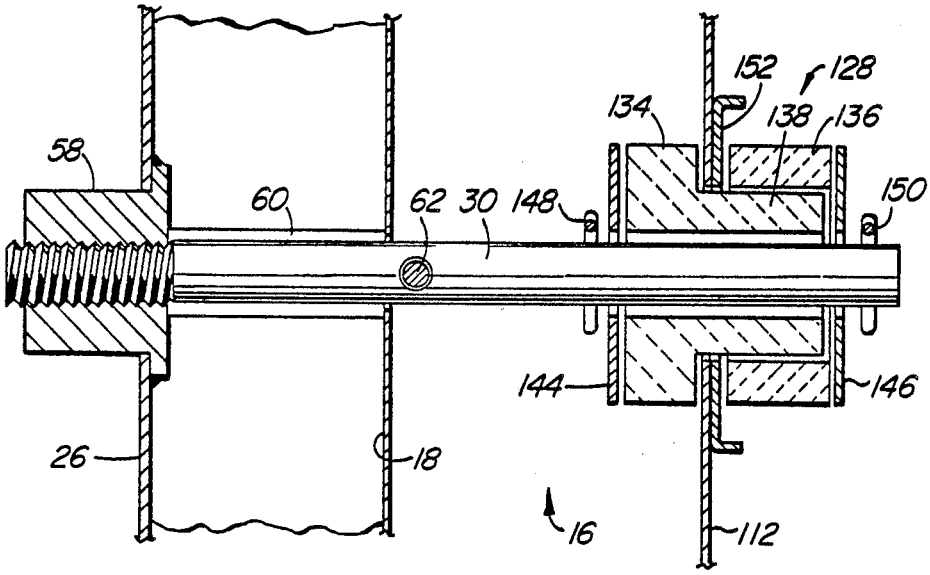
FIG. 4 is a cross sectional view similar to FIG. 2 but showing another arrangement of the element support assembly.
Figure 5:
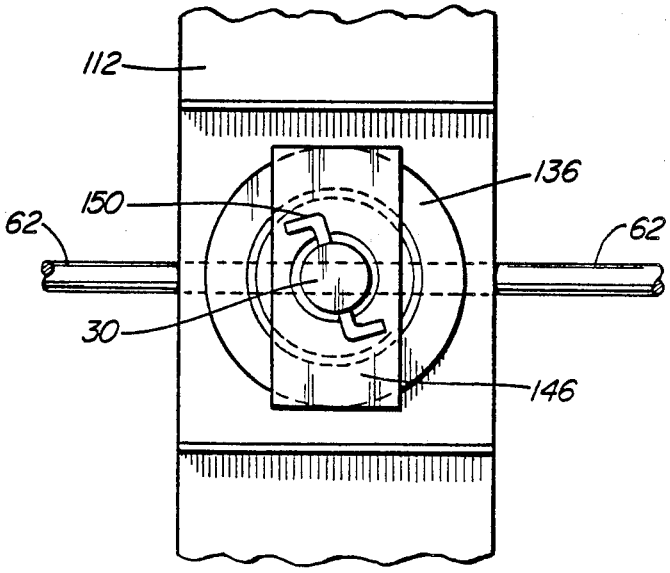
FIG. 5 is an end view of the arrangement in FIG. 4.

The support assembly shown in FIG. 4 has a second ceramic member 136 in the form of a sleeve which telescopically receives the boss 138 of the first ceramic member 134. As in the embodiment of FIG. 2, the locking pins 148 and 150 sandwich the assembly of the two ceramic members 134, 136, the heating element 112 and strengthening member 152 as well as the clips 144 and 146.

According to the arrangement of the present invention the support rods can be easily removed without removing the hot zone package from the furnace. This can be accomplished by removing the pin 50 and then in turn the ceramic insulator 36, heating element 12, ceramic insulator 34 and retaining pin 48. Finally, the retaining rod 62 is removed and the support rod 30 can be unscrewed from the captive nut 58.

The provision of the strengthening or stiffening member 52 at the point of support for the resistant heating element 12 substantially strengthens the element at this point. This is a distinct advantage, particularly on furnaces with vertically aligned chambers where sheet metal heating elements with conventional reinforcement clips, tend to sag and distort when operating at elevated temperatures.

Referring to FIGS. 6 through 9, the present invention provides an improved arrangement for mounting gas nozzles 160 to the support liner 26 of vacuum furnaces. Similar to conventional design, the tubes are rolled from a flat sheet of suitable material, the ends wired or rivetted together and fitting over the spigot holes in the support liner.

This arrangement comprises a length of thin flat bar 158 with a securing hole at each end, supported on the one end by a retaining pin 156 of molybdenum or other high temperature material and passing through two diametrically opposite holes in the nozzle spigot 154 and supporting at the other end, the gas nozzle 160 by means of a retaining rod 62 also of molybdenum or other high temperature material. This rod serves a double purpose of holding the gas nozzle 160 in position over the spigot 154 in the liner and also retaining the insulation or heat reflecting shields 18 against the support liner 26.

Figure 6:
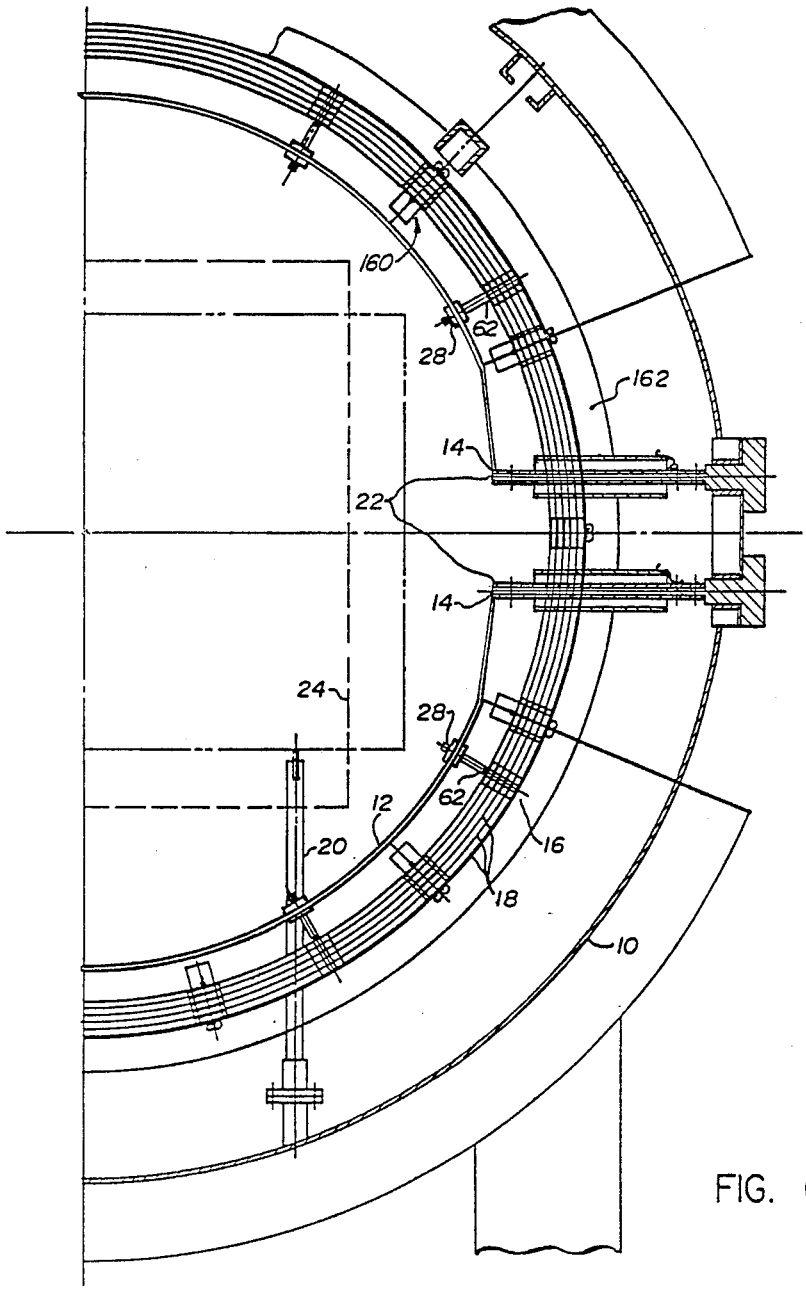
FIG. 6 is a fragmentary schematic view of a portion of a vacuum furnace incorporting gas nozzle supports.
Figure 7:
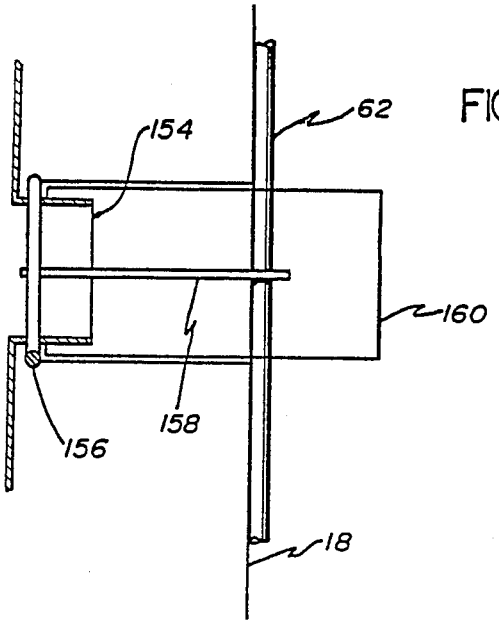
FIG.7 is a cross-section view of the gas nozzle arrangement.
Figure 8:
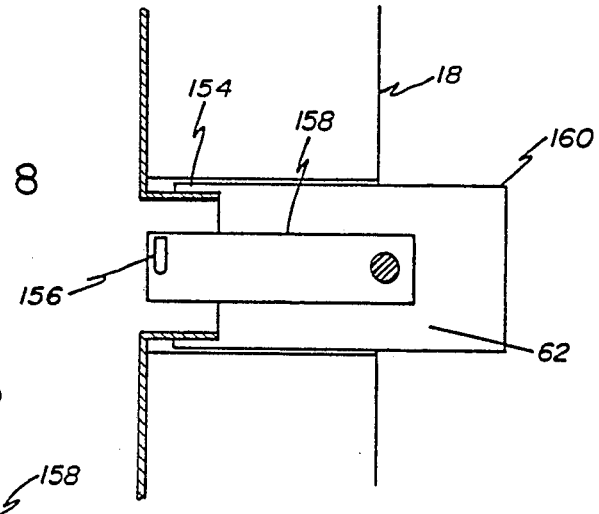
FIG. 8 is another cross-sectional view of the arrangement.
Figure 9:
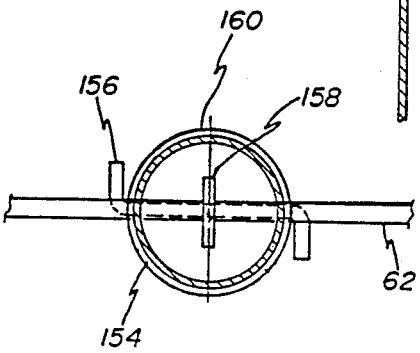
FIG. 9 is an end view of the arrangement in FIG. 3.

This invention allows quick and easy removel and replacement of gas nozzle tubes 160 simply by removing the retaining rod 62 without disturbing any other parts of the heat shield package, resulting in reduced distortion from thermal shock during heating and cooling. As seen in FIG. 6, quenching gases are distributed to each gas nozzle by means of a plenum or duct 162 the inner wall of which is also support liner 26.

While the invention has been described in connection with a specific embodiment thereof and in a specific use, various modifications thereof will occur to those skilled in the art without departing from the spirit and scope of the invention as set forth in the appended claims. The terms and expressions which have been employed in this specification are used as terms of description and not of limitation and there is no intention in the use of such terms and expressions to exclude any equivalents of the features shown and described or portions thereof.

The embodiments of the present invention in which an exclusive property or privilege is claimed are defined as follows:

1. An improved support means for a resistance heating element of a vacuum furnace, said support means comprising a support liner, a heating element support assembly and a rod member interconnecting the support liner and the element support assembly;

said element support assembly being mounted on the inner end of said rod and including a pair of insulators concentrically located on said rod and defining between them an insulated groove freely supporting said heating element thereon;

means locating retaining the element support assembly on the inner end of said rod;

a retaining rod interconnecting adjacent rod members and spacing the support liner from the element support assembly;

means secured to the support liner and releasably engaging the outer end of said rod member; and means located in the groove of the insulators and secured to the heating element to strengthen said element at the support assembly.

2. A support means according to claim 1 wherein the pair of insulators include a first ceramic member having a peripheral flange and a concentric protruding boss and a second ceramic member having a diameter greater than said boss, and together with said peripheral flange, defining said insulated groove therebetween.

3. A support means according to claim 2 wherein said second ceramic body is a sleeve mounted over said boss of the first ceramic member in telescopic relationship.

4. A support means according to claim 1 wherein the locating and retaining means comprises clip member on either side of said insulators and pin members positioned on said rod to sandwich said insulators and clips.

5. A support means according to claim 1 wherein the means secured to the support liner is a captive nut welded thereto and threaded to receive the outer end of said rod member.

6. A support means according to claim 1 wherein the means to strengthen said element comprises a channel shaped member of the same material as said element and having a flat rectangular web portion secured to the element with stiffening ribs along parallel side edges thereof.

7. A support means according to claim 1 including means for transferring quenching gases to the interior working space of said vacuum furnace comprising an integral manifold support ring assembly and a plurality of locked in tubes which route gases directly into the working section of the furnace.

8. A support arrangement according to claim 7 wherein the assembly comprises a thin flat bar having an aperture at each end thereof, a retaining pin supporting one end of said flat bar, said pin passing through two diametrically holes in the nozzle spigot, said bar supporting the gas nozzle at the other end thereof by means of a retaining rod which secures the gas nozzle in position over said spigot and also retains the insulation or heat reflecting shields against the support liner.

* * * * *